US005823320A

United States Patent [19]

Seidel et al.

[11] Patent Number: 5,823,320

[45] Date of Patent: Oct. 20, 1998

[54] INSERTER FOR FLAT PRODUCTS

[75] Inventors: Randy R. Seidel, Allentown; Lawrence Bush, Nazareth; Neal Cohen, Flourtown; Gary L. Davenport, Sellersville, all of Pa.; Robert M. Silva, Milford, N.J.; Roger Honegger, Yardley, Pa.

[73] Assignee: Graphic Management Associates, Inc., Del.

[21] Appl. No.: 401,425

[22] Filed: Mar. 9, 1995

[51] Int. Cl.[6] ..... B65G 17/46

[52] U.S. Cl. ..... 198/803.5; 198/803.7; 270/52.19; 270/52.24

[58] Field of Search ..... 198/803.5, 803.7; 271/188, 194, 196, 277; 270/52.16, 52.19, 52.24, 52.25, 58.24, 58.29

[56] References Cited

U.S. PATENT DOCUMENTS

| | | | |
|---|---|---|---|
| 4,467,912 | 8/1984 | Rathert | 198/803.7 |
| 4,723,770 | 2/1988 | Seidel et al. | 198/803.5 |
| 4,921,294 | 5/1990 | Klopfenstein | 198/803.7 |
| 5,064,187 | 11/1991 | Muller | 198/803.7 |
| 5,421,568 | 6/1995 | Linder | 270/52.19 |
| 5,450,939 | 9/1995 | Meyers | 198/803.5 |

*Primary Examiner*—Joseph E. Valenza
*Attorney, Agent, or Firm*—Jordan B. Bierman; Bierman, Muserlian and Lucas

[57] ABSTRACT

A device for transporting flat products consisting of feeders for introduction of flat products into openable pockets. The pockets move in a closed path and each receives one or more inserts. Specific and preferred pocket conveyor, sprocket, and divider designs are also set forth.

62 Claims, 11 Drawing Sheets

INSERTER FOR FLAT PRODUCTS

The present Invention is directed to devices which enable the insertion of substantially flat inserts into openable products located in moving pockets, as well as improvements in the pockets themselves. The Invention will be specifically described with regard to transportation of newspaper jackets and insertion of various supplemental materials therein, but is not intended to be limited thereto. It is particularly useful in connection with flat products, especially those which are incapable of supporting their own weight.

BACKGROUND OF THE INVENTION

Devices for introducing supplements into outer sections of newspapers have been known for many years. Generally, they comprise a plurality of pockets mounted on a chain movable in a closed path. An outer section or jacket is introduced into each of the pockets, usually with the folded edge adjacent the hinge. The pocket is then closed, the edges of the paper remote from the hinge are held to the inner faces of the pocket, and the pocket is thereafter opened. As a result, the pocket now contains the jacket in opened position, ready to receive the inserts. As the pockets move in a closed path, part of which carries them adjacent devices which feed the inserts into the jackets, they are then transported to the next step in the handling thereof.

SUMMARY OF THE INVENTION

The present Invention comprises a device for transferring a plurality of flat products (i.e. newspaper jackets and/or inserts therefor) individually into a plurality of pockets attached to —and spaced apart along—an endless conveyor moving in a closed path in a downstream direction. Each of the pockets includes a downstream wall, having an upper edge and a lower edge parallel thereto, and an upstream wall, (which may be connected by a hinge to the downstream wall adjacent the lower edge); the walls are capable of movement between an open position, wherein they are spaced apart, and a closed position, wherein they are adjacent to or bear against each other. Each of the pockets is attached to a conveyor, preferably at both sides thereof and at points intermediate their lower edge and the upper edge. The pockets are oriented so that, during one flight of the conveyor, each lower edge is below its corresponding upper edge.

For convenience, the Invention will be primarily described in connection with pockets wherein the walls are hinged to each other at their lower ends. In addition, the description will focus on pockets wherein the upstream wall is movable and the downstream wall is fixed. However, it is to be understood that these are not limitations on the Invention, but rather that it is broad enough to encompass pockets wherein the walls are not hinged to each other, and in which either or both of the walls are movable.

The conveyor passes around a rotatable member at extremities of the path. The rotatable members have diameters which are greater than the distance between adjacent flights of the conveyor, so that the lower edges do not contact each other as the conveyor passes around the rotatable members. Thus, the conveyor has raised ends and a lowered central portion. Since the operators place the inserts in the feed hoppers along the central portion, it is of advantage to keep the center low so as to facilitate this operation.

In a desirable form of the pockets of the Invention, at least one wall carries an actuator bar which is substantially parallel to the hinge; the bar is slidably mounted thereon so that it can move in a direction substantially perpendicular to the hinge. Thus, when pressure is exerted on the bar, the wall is biased toward one of its two positions, preferably toward the closed position. In a preferred form of the Invention, the bar is mounted loosely in its bracket. Thus, the wall is permitted substantial flexibility to accommodate outer sections into which the inserts have been unevenly introduced.

In a further embodiment of the present Invention, each of the pockets carries a first pair of bushings, one on each side thereof. The bushings are adapted for connection to complementary bushings on the following pocket. Similarly, the preceding pocket has bushings which are connected to the first pocket, thereby coupling the pockets together along the path of the conveyor. Associated with the bushings are rollers which support the pockets and also cooperate with the sprockets at the ends of the path to drive the conveyor. Specifically, the rollers fit into notches on the sprocket.

The sprocket is also provided with a plurality of opening cams, one for each notch. As each pocket is engaged by the sprockets, the opening cams, cooperating with cam followers on the pockets, cause the pockets to open and remain open during the travel of the pocket around the sprocket. As a result, when the pocket reaches its inverted position, any residual papers or inserts fall out under the influence of gravity. A further stationary cam is provided as the pockets exit the sprockets to prevent sudden closing thereof. As a result, the pockets are first opened, then emptied, and then allowed to close slowly to avoid damage.

In Missed Insert Repair Systems (MIRS), provision is made for the failure of a given insert station to feed its insert into the opened jacket. When this is detected, the remaining insert stations are disabled for this specific pocket. This pocket is then permitted to go around the complete cycle and return to its first missed insert station, at which point the station, as well as the subsequent stations, is enabled once again so that the paper receives all of its intended inserts. However, in order to accomplish this, it is necessary that, when this pocket reaches the sprocket, it remains closed so that the jacket and the inserts which have been properly introduced do not fall out. To do this, the opening cams on the sprocket are movable, preferably in a direction perpendicular to the plane of the sprocket. In one position, the opening cam contacts the cam follower to open the pocket in the normal way. However, when a missed insert pocket reaches the sprocket, the opening cam is moved into another position wherein it does not contact the cam follower. As a result, this pocket is not opened and the portion of the paper contained therein remains so that a suitable repair can be made.

In a further aspect of the present Invention, the edges of the jackets are secured to the inner surfaces of the walls by the application of vacuum thereto. To accomplish this, there is provided a stationary plenum which is adjacent one side of the openable pockets. Each pocket is provided with a suction cup connected to vacuum tubes which terminate at the face of one of the walls thereof, preferably the fixed downstream wall. An endless belt, which passes around rotatable idlers at its extremities, is located so that one flight thereof is between the plenum and the pockets. Vacuum holes are provided on the belt, spaced apart at a distance corresponding to the distance between successive vacuum cups on the pockets. The belt also has notches or teeth and the pockets are adapted to engage the belt at the notches or teeth, thereby driving it. In this manner, the vacuum in the plenum is transferred to the pockets. Since the pockets themselves drive the belt, proper timing is insured without the necessity of expensive or complicated mechanisms.

As an alternative construction, the belt may carry vacuum transmitting elements which bear against—and are complementary to—the vacuum inlets on the corresponding pockets. Protuberances can be provided on the belt which are engaged by the pockets.

Another embodiment is directed to the provision of a pair of flexible—preferably leaf—springs on the upstream wall. These springs urge the paper, when in the pocket, toward the downstream wall and away from the upstream wall. They are located near the fold so that they do not interfere with the opening of the jacket. Alternatively, the springs can be mounted on the downstream wall and urge the jacket toward the upstream wall.

The springs provide a further advantage. At high speed, the jackets are inserted into the pockets at a very rapid rate. As a result, there is a tendency for them to rebound when they hit the bottom of the pocket. The presence of the springs cushions the stop and aids in preventing the paper from becoming misaligned due to the speed at which it is introduced.

In another preferred form of the device, the pockets have a spring (advantageously a compression spring), with a fixed end mounted on the outer surface of the downstream wall. The spring extends, from the fixed end, parallel to the outer surface, toward the lower edge thereof, and terminates in a movable end. There is a lever, pivotally mounted on the downstream wall at a pivot point, which has an actuated arm extending from the pivot point with a distal end in contact with the movable end of the spring. The lever also has a receiving arm extending from the pivot point toward the upstream wall and terminating at a pressure end, the pressure end being in contact with the upstream wall. As a result, the compression spring exerts pressure on the actuated arm, through the pivot, to the receiving arm, whereby the pressure end urges the upstream wall toward the closed position.

This receiving arm is connected to an actuator bar which is loosely mounted on the upstream wall. The bar extends substantially parallel to the hinge and is retained in a bracket which is elongated in the direction perpendicular to the hinge. Thus, when the pocket is closed, the actuator bar bears against the upstream wall and presses it firmly against the downstream wall. However, as the pocket is opened, the actuator bar presses against the underside of the portion of the bracket which is parallel to the upstream wall. Since the actuator bar is loosely mounted therein, the upstream wall is no longer rigidly secured. As a result, it can flex to accommodate uneven inserts, when in the closed position. As a modification of the foregoing, the compression spring may be mounted on the upstream wall or there may be compression springs on both walls.

In a somewhat different context, a further problem may arise which is also solved by a feature of the present Invention. In the double feed mode, a pair of jacket feeders is provided, each operating at half speed and feeding alternate pockets. As a result of the slow speed of each hopper, relative to the speed of the pocket conveyor, the jackets fed thereby may not fully enter the opened pocket as it passes beneath the feeder. As a result, as the falling jacket is hit by the horizontally moving upstream wall, there is a tendency for the trailing portion of the jacket to fall over the upper edge of the upstream wall in the upstream direction. This prevents the jacket from sliding entirely into the pocket and may also interfere with the introduction of the jacket into the following pocket by the adjacent feeder.

To solve this problem, the pockets are provided with a device which causes the jacket to assume an arcuate configuration which is concave in the upstream direction. As a result, the jacket is stiffened and its tendency to fold over the upper edge of the upstream wall is minimized. This facilitates its slide into the pocket to reach the bottom thereof.

In one form of the present Invention, the upstream wall of each pocket, when in the open position, is adjacent the downstream wall of the pocket immediately upstream thereof. The device for causing the arcuate formation is on the downstream side of the downstream wall of the upstream pocket. For example, a suitable chamfer angling inward and downward intermediate the sides of the downstream wall has been found suitable for this purpose. Alternative constructions are also available. The downstream wall may have a V-notch or protuberances thereon to cause the desired shape to be formed. A further possibility is the use of an arcuate shape of the wall to achieve the same result. It is to be understood that the present Invention is not limited to any particular means for forming this shape, as alternatives to the foregoing will readily suggest themselves to the person of ordinary skill. Furthermore, although it is preferred that the shape be concave in the downstream direction (convex in the upstream direction), it is entirely feasible to accomplish the reverse, i.e. the shape can be convex in the downstream direction (concave in the upstream direction).

BRIEF DESCRIPTION OF THE DRAWINGS

The accompanying drawings, in which like reference characters indicate like parts.

FIG. 16 is a partial schematic perspective of the inventive pocket showing the leaf springs.

DETAILED DESCRIPTION OF THE INVENTION

Figure 1:
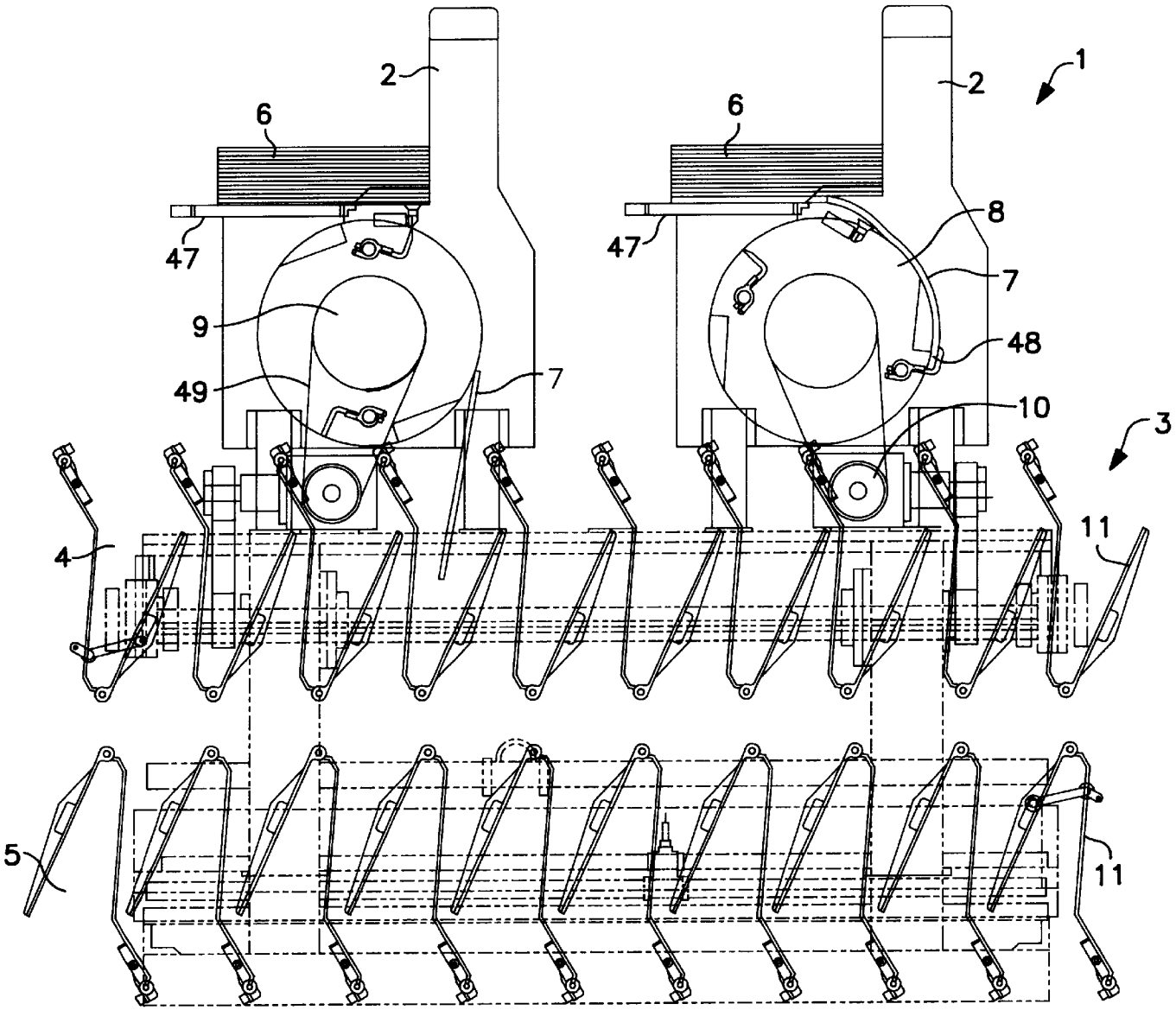
FIG. 1 is a schematic elevation of the device of the present Invention with parts omitted for clarity.

Transfer device 1 comprises feeders 2 and conveyor 3. Conveyor 3 forms outgoing flight 4, wherein pockets 11 are prepared to receive a product from stack 6. Singulator 47 feeds one product 7 to gripper 48 which carries it around feed wheel 8. Drive sheave 10, through drive belt 49, rotates feed wheel 8. Jacket 7, as shown in the left feeder 2 of FIG. 1, is then dropped into one of pockets 11.

Figure 2:
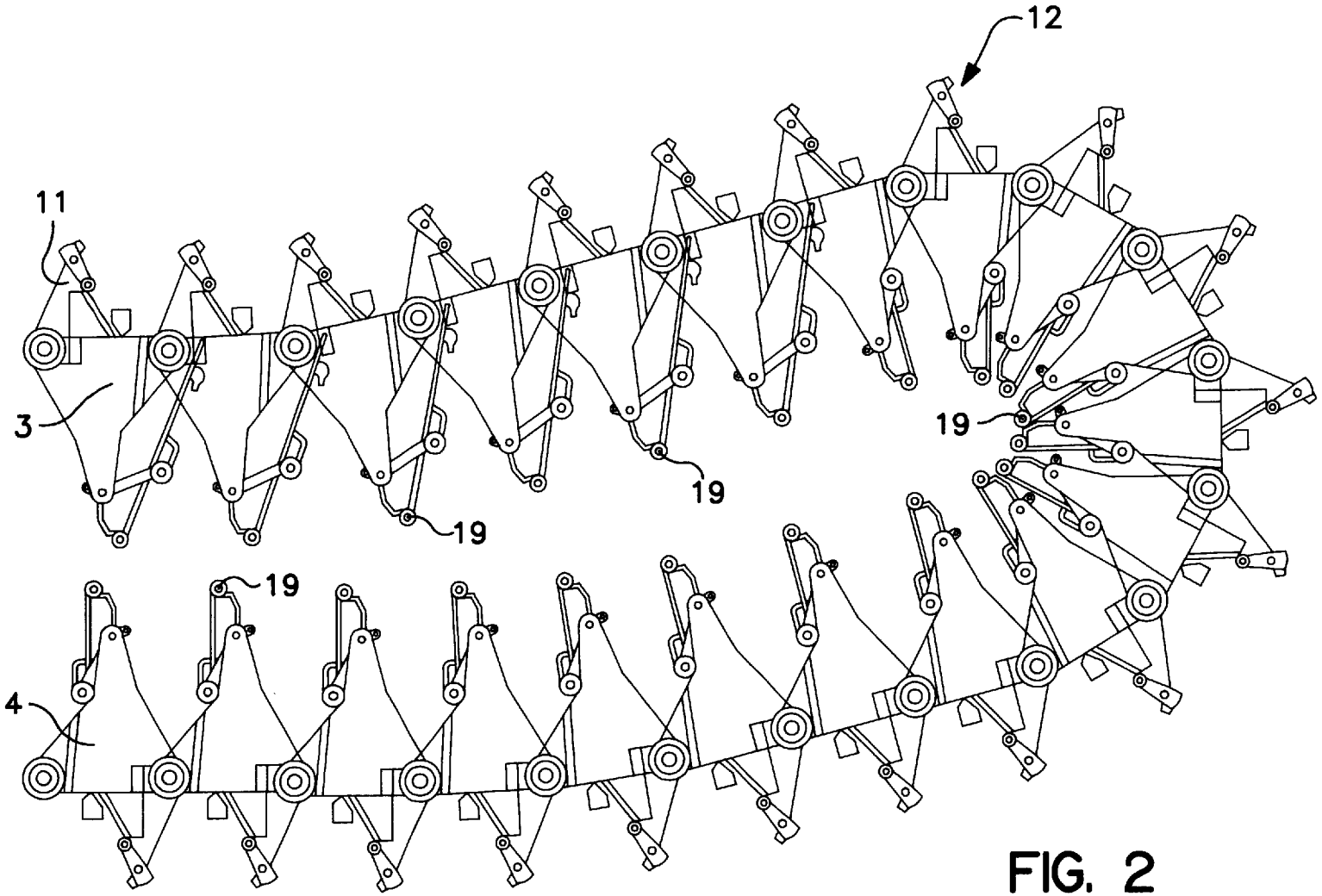
FIG. 2 is a schematic elevation of one end of the conveyor of the present Invention with parts omitted for clarity.

As can be seen particularly in FIG. 2, hinges 19 approach each other very closely as the conveyor travels around pairs of sprocket wheels at the extremities of the path. In order to permit this, enlarged diameter section 12 is provided at these points. This enables hinges 9 to clear one another during this portion of the travel and still allow flights 4 and 5 to be relatively close to each other. It provides an added advantage whereby flight 4 can be located at a convenient height for the operator(s).

Figure 14:
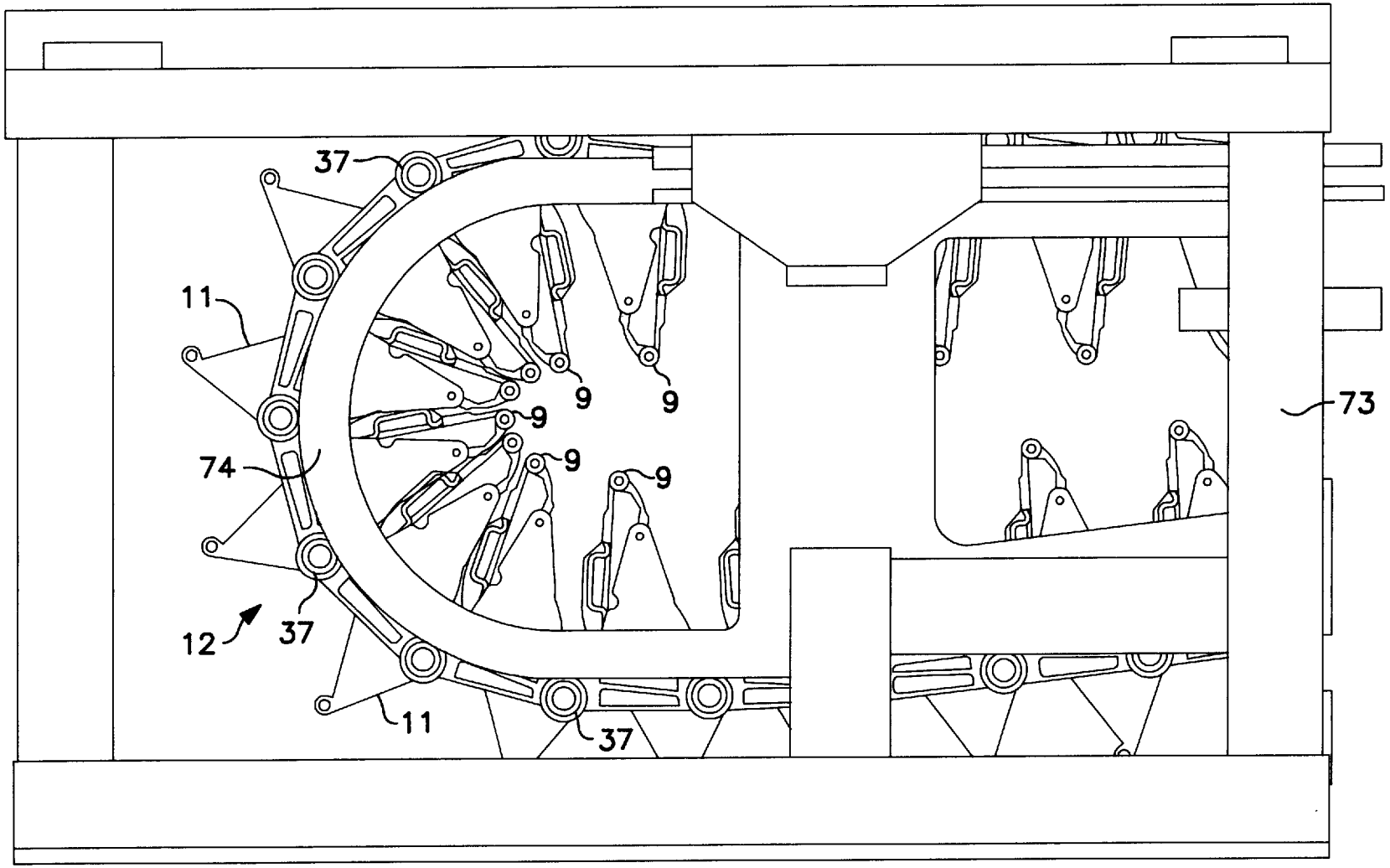
FIG. 14 is a schematic elevation of the end of the conveyor opposite to that of FIG. 2.

The idler end of conveyor 3 may comprise sprocket wheels analogous to those shown in FIG. 2. However, it has been found advantageous to use the construction of FIG. 14. As can be seen therein, enlarged diameter section 12 is shown within frame 73. Idler cams 74 are provided and rollers 37 roll thereover. This eliminates the necessity for a second pair of sprocket wheels.

Figure 3:
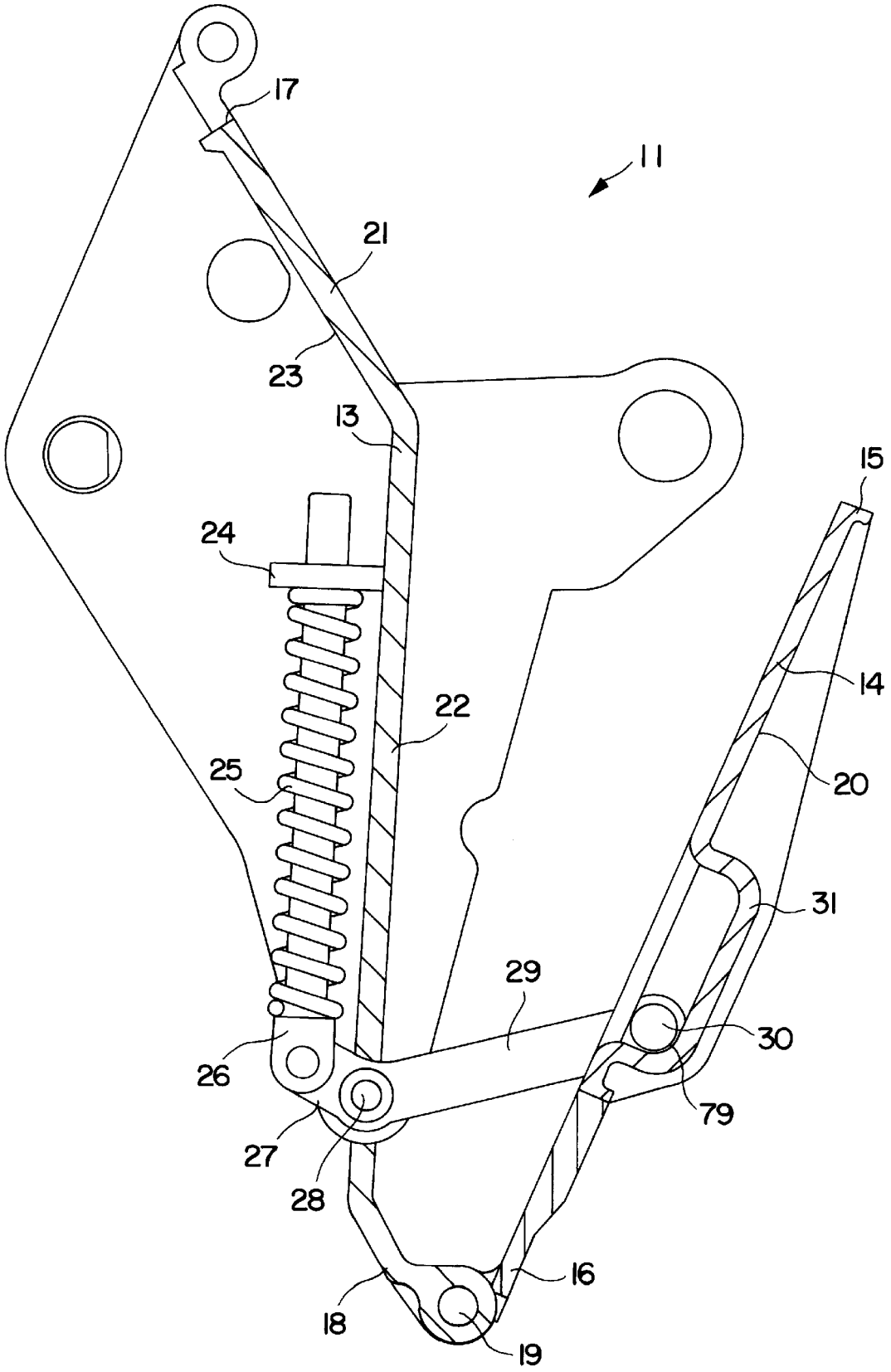
FIG. 3 is an enlarged sectional view of a pocket according to the present Invention.

The construction of pocket 11 is best shown in FIG. 3. It comprises fixed wall 13 having upper edge 17 and lower edge 18. Movable wall 14 includes far edge 15 and near edge 16. Fixed wall 13 and movable wall 14 are connected at hinge 19 adjacent near edge 16 and lower edge 18. Fixed wall 13 has upper portion 21 which is at an angle to lower portion 22. On outer surface 23 is mounted compression spring 25 extending between fixed end 24 and movable end 26. Actuated arm 27 connects movable end 26 with pivot 28. On the other side of pivot 28 is receiving arm 29 which engages actuator bar 30. Exterior surface 20 of movable wall 14 carries bracket 31 in which bar 30 is slidable.

Figure 13:
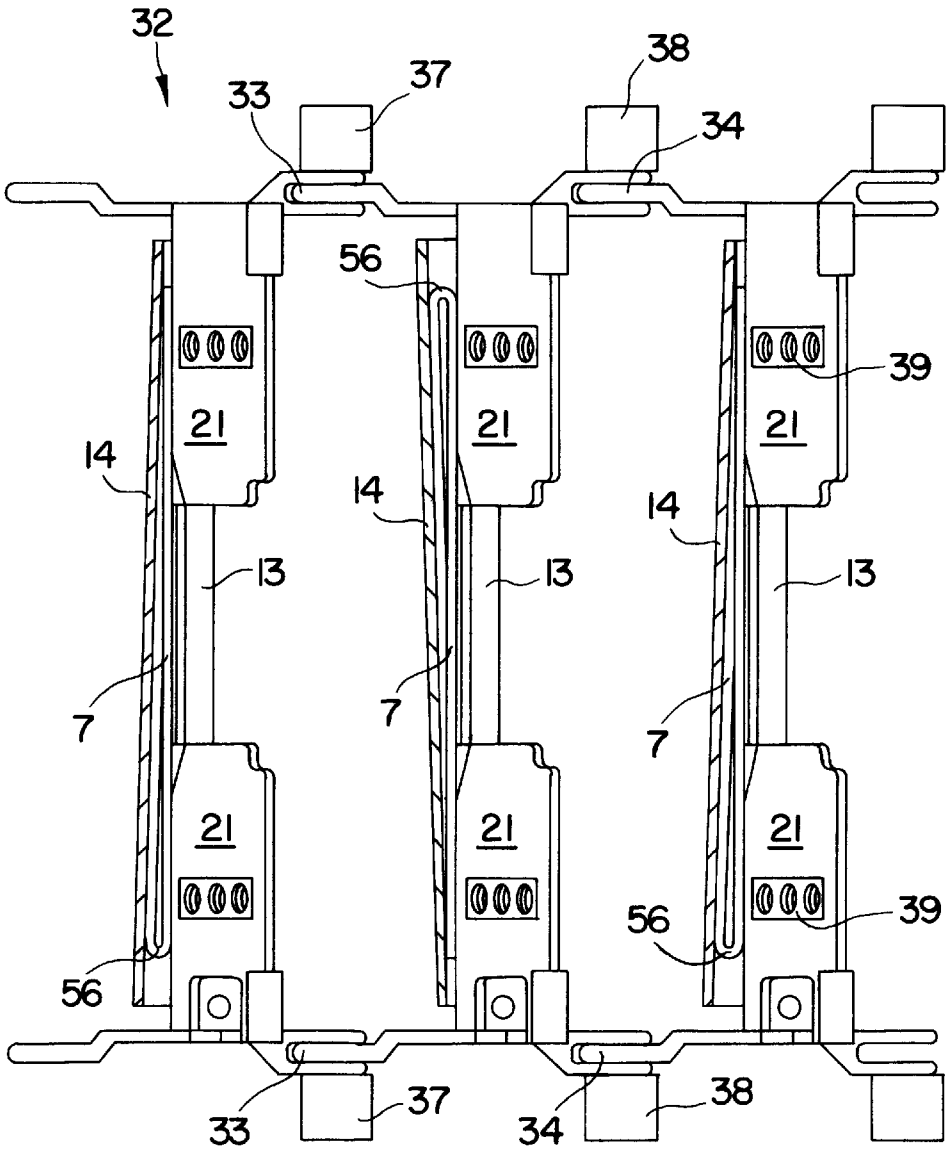
FIG. 13 is a view similar to that of FIG. 5 with the pockets closed.

Referring to FIGS. 3 and 13, the pockets are shown in open and closed position, respectively. Actuator bar 30 is loosely mounted in bracket 31, thus forming gap 79. The loose fit permits movable wall 14 to assume positions which are not parallel to fixed wall 13 when in the closed position. Thus, if inserts into jacket 7 are introduced unequally, thick end 56 can be accommodated without risk of damaging movable wall 14 or allowing the inserts to slip out. In operation, the pressure of spring 25 on movable end 26 urges actuated arm 27 in the downward direction as shown in FIG. 3. This force is transmitted through pivot 28 to receiving arm 29 and causes bar 30 to move upwardly in bracket 31, thereby bringing movable wall 14 to its closed position. As shown in FIG. 16, movable wall 13 is provided with leaf springs 83 which urge the paper toward the fixed wall. Springs 83 are short so that they do not interfere with the opening of the paper for receipt of inserts.

Figure 4:
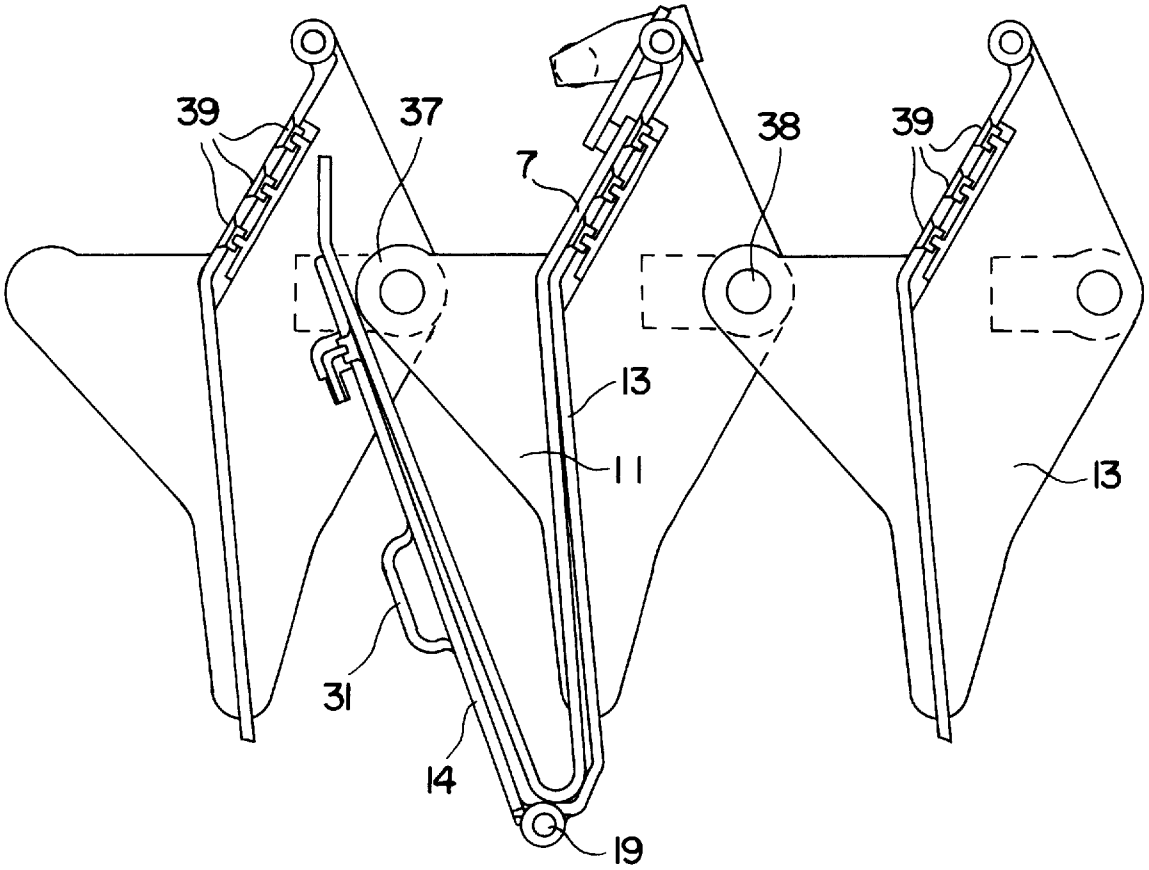
FIG. 4 is a schematic elevation showing the successive pockets which form a linked plurality thereof.
Figure 5:
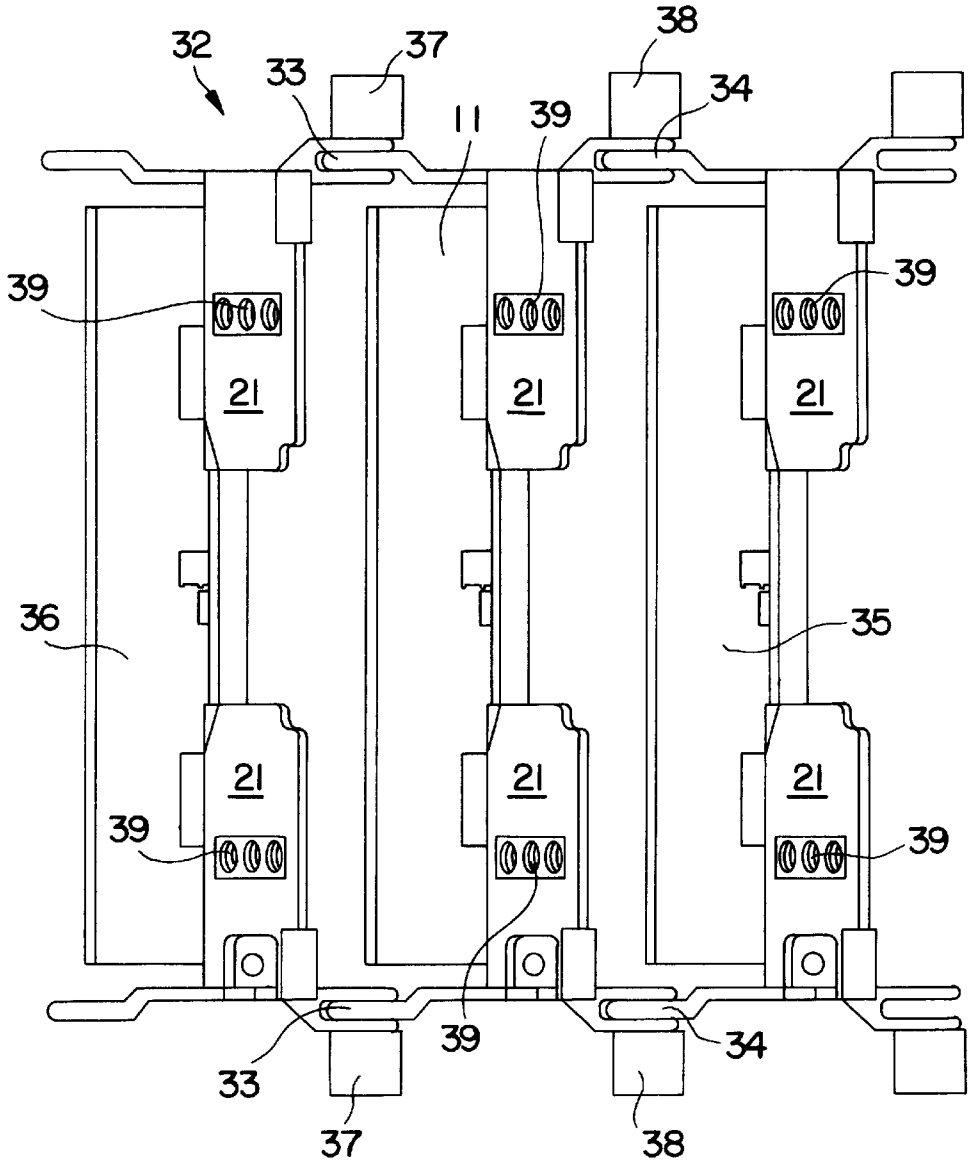
FIG. 5 is a plan view of FIG. 4.
Figure 6:
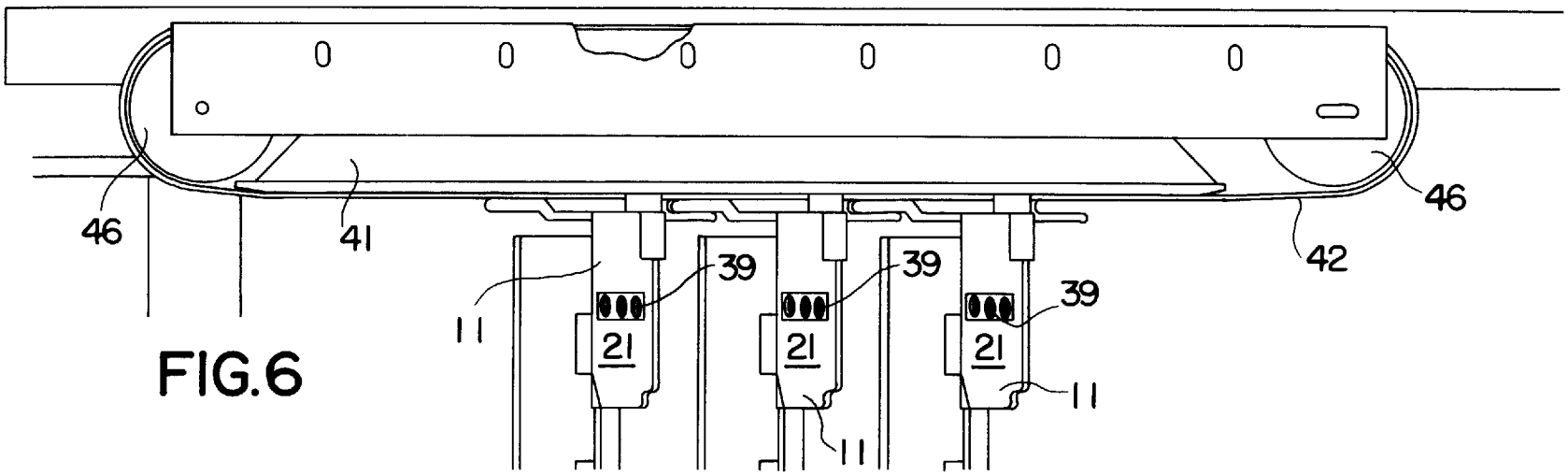
FIG. 6 is a plan view of the apparatus for application of vacuum to the pockets.
Figure 9:
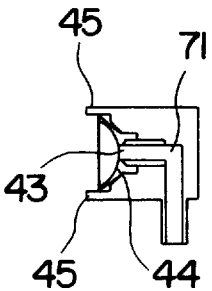
FIG. 9 is a partial, fragmentary view of the vacuum cup on a pocket.
Figure 8:
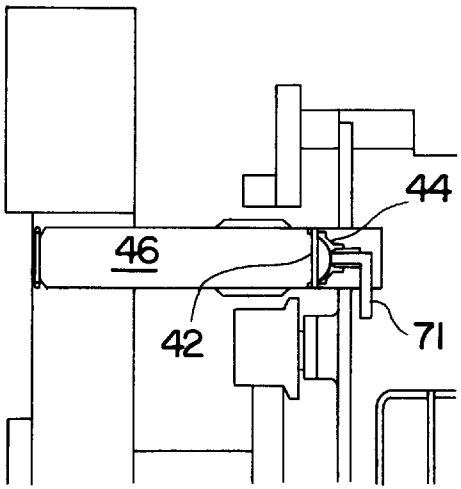
FIG. 8 is a schematic view from the left end of FIG. 6.
Figure 7:
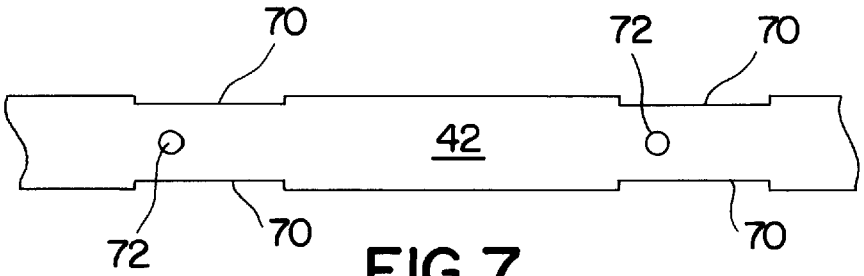
FIG. 7 is an enlarged fragmentary view of the belt of FIG. 6.

Referring more specifically to FIGS. 4 and 5, the formation of linked plurality 32 of pockets 11 is shown. Center pocket 11 has following bushings 33 which engage following pocket 36; similarly, preceding bushings 34 engage preceding pocket 35. Rollers 37 and 38 support plurality 32 and the pockets. For use in connection with vacuum, vacuum inlets 39 are provided in upper portion 21 of the pockets.

Figure 15:
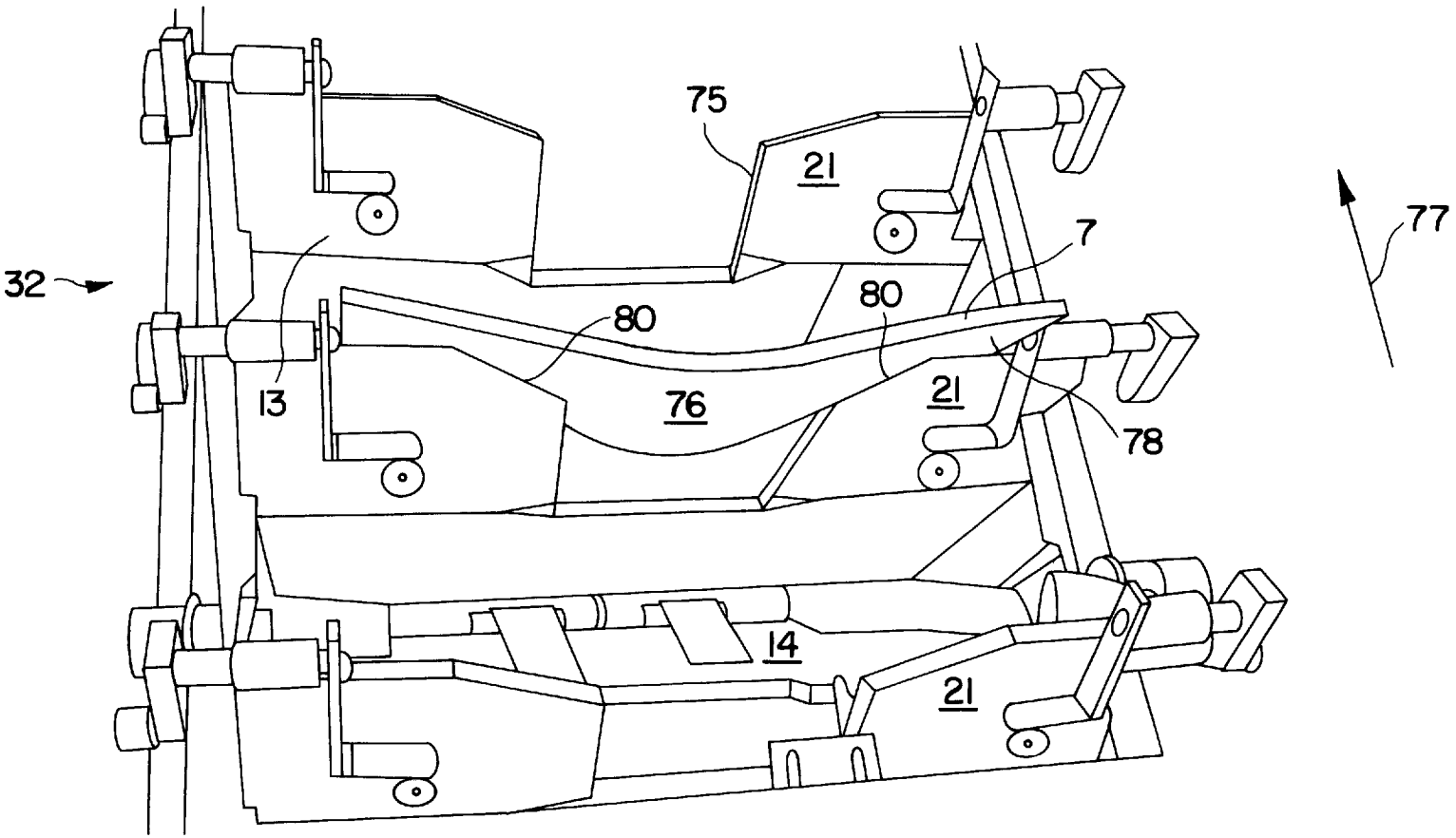
FIG. 15 is a perspective view analogous to that of FIG. 5 with parts broken away for clarity.

Linked plurality 32 of pockets 11 is shown in perspective in FIG. 15. It is a feature of one embodiment of the present Invention that fixed wall 13 is provided with chamfers 80. As jacket 7 is inserted into pocket 11, the force of movement in the downstream direction of arrow 77, together with the configuration of the device, (especially chamfers 80), causes jacket 7 to bow at 76 in the upstream direction . This curved shape tends to stiffen jacket 7 and prevent upper end 78, which extends beyond upper portion 21 of pocket 11, from folding over the outer surface of upper portion 21.

The manner of formation of the bow at 76 is not critical. Providing fixed wall 13 with chamfers 80 is one way of accomplishing this. Alternatively, downstream wall 13 and/or upstream wall 14 may be arcuate in shape, bowing upstream in the direction opposite to arrow 77. Thus, when paper 7 rests thereon, it assumes the desired shape. In another modification, chamfers 80 can be a V-shape, which would achieve substantially the same result. Even protuberances extending downstream from the downstream face of fixed wall 13 will provide the bowing effect.

While FIG. 15 shows the elements for causing bowing at 76 on fixed wall 13, this is not essential. Movable wall 14 can carry similar devices to accomplish the same result. In the latter case, however, it is more advantageous if there is a space between movable wall 14 of one pocket 11 and fixed wall 13 of the immediately upstream pocket 11 when the pocket is in its open position.

Figures 10, 11:
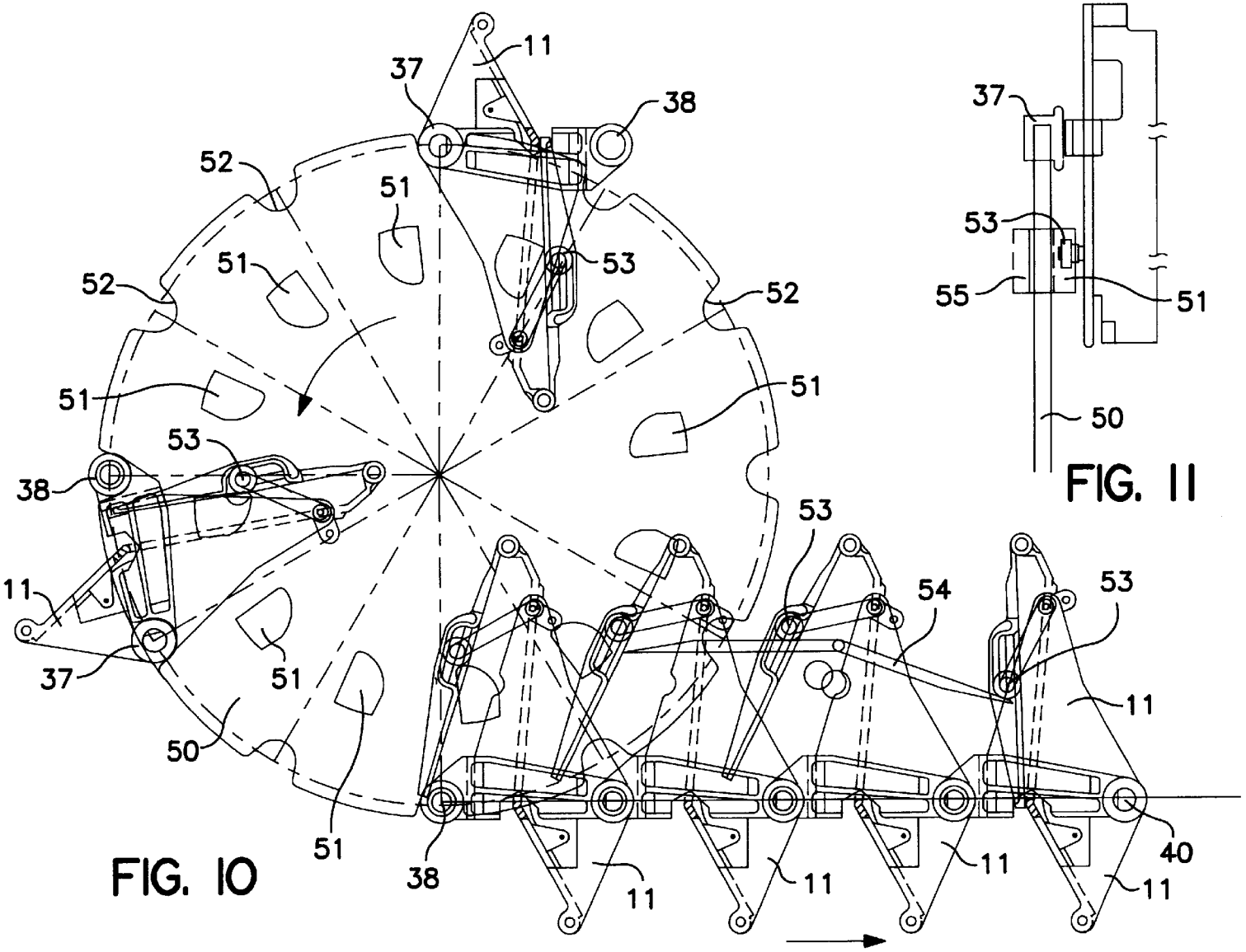
FIG. 10 is a partial fragmentary elevation of the sprocket and pockets, some parts being omitted for clarity.
FIG. 11 is a partial, fragmentary view taken from the right side of FIG. 10.

In order to be certain that the pockets are empty of any residual papers or inserts at the end of the insertion cycle, the sprocket is provided with a particular mechanism for doing so. As shown in FIGS. 10 and 11, sprocket 50 carries notches 52 into which support rollers 37 and 38 of pockets 11 fit. As sprocket 50 rotates in the direction of the arrow shown in FIG. 10, cam followers 53 bear against opening cams 51. Locking support roller 37 enters notch 52; thereafter, trailing support roller 38 enters the next notch 52. This causes cam follower 53 to bear against cam 51, thus opening the pocket, the rotation of sprocket 50 inverts the open pocket. As a result, pockets 11 are emptied by a combination of centrifugal force and gravity. In order to prevent pockets 11 from snapping shut violently, and hence risking damage thereto, stationary cam 54 bears against cam followers 53 and guides them so that closure of pockets 11 is accomplished slowly.

A modification of the foregoing is useful when the Missed Insert Repair System is being used. When this system senses that an insert has been missed, it disables the gripper opening cam so that the paper will go through a second cycle to pick up the missing insert. In the most preferred form of the device, all of the inserting stations subsequent to the one which was missed are also disabled. Thereafter, when the paper is returned to the original missed station, all of the subsequent stations are enabled.

In this situation, the specific pocket to be recycled must not be opened and emptied when traveling around sprocket 50. This is accomplished by moving the selected opening cam 51 which corresponds to the missed insert pocket in a direction perpendicular to the plane of sprocket 50. Opening cam 51 becomes inoperative cam 55 as shown in dotted lines in FIG. 11. In this position, the cam does not contact cam follower 53 and the specific pocket is not opened.

The vacuum system is shown in FIGS. 6, 7, 8, and 9. Plenum 41 is located within the path of vacuum belt 42. Upper portions 21 are equipped with suction inlets 43 which are in communication with vacuum inlets 39. On belt 42 are vacuum holes 72. Idlers 46 permit belt 42 to be driven by pockets 11. In operation, teeth 45 mounted on pockets 11 engage notches 70 on belt 42. As pockets 11 are driven, belt 42 is carried along therewith. Since plenum 41 is under vacuum, this vacuum is communicated through vacuum holes 72, vacuum cups 44, suction inlets 43, and vacuum tubes 71 to vacuum inlets 39. Plenum 41 is proportioned with regard to the cycle of pockets 11 so that vacuum is applied thereto only when required.

Figure 12:
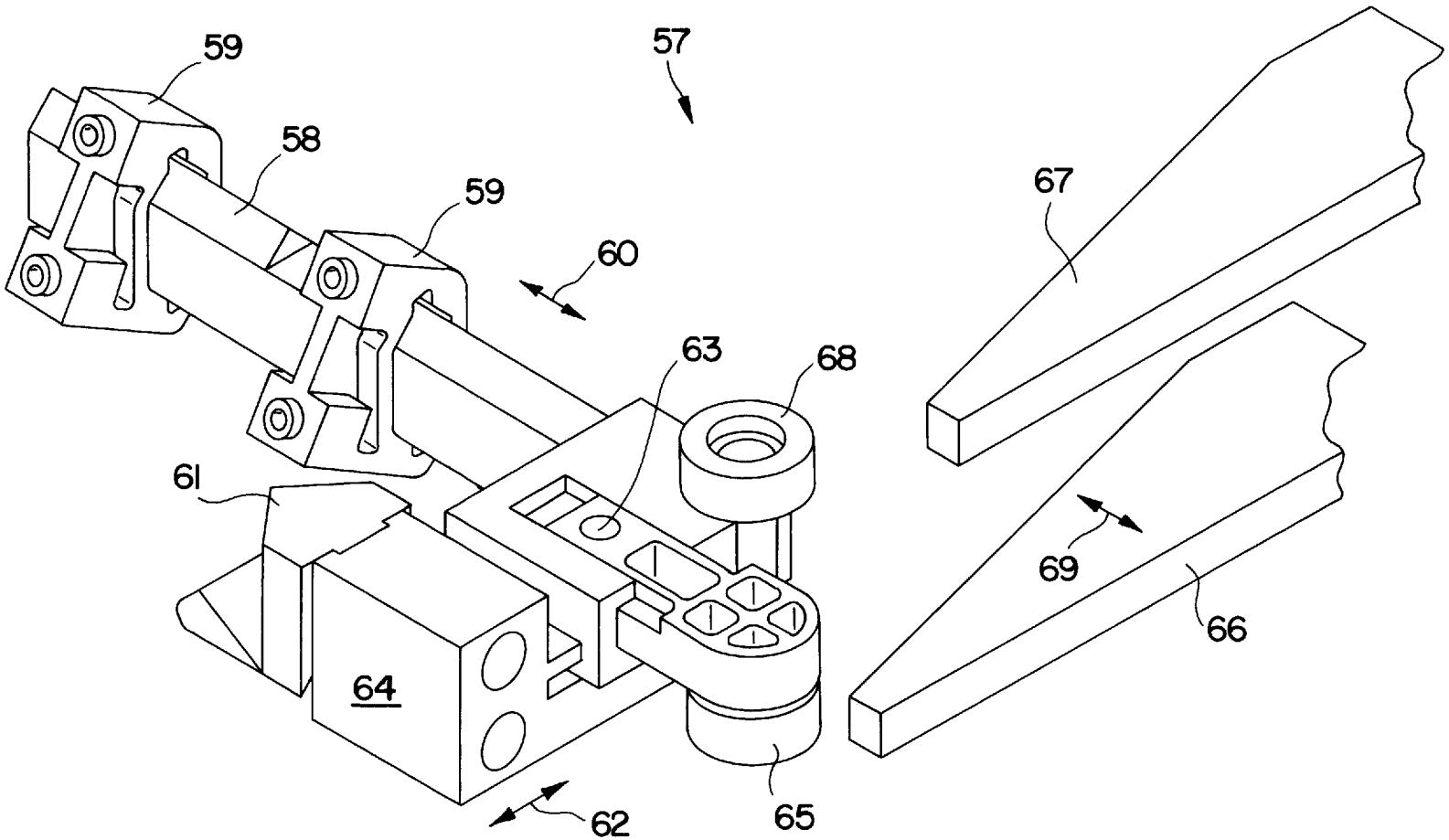
FIG. 12 is a schematic perspective view of the side opener assembly.

In operating apparatus of this kind, it is desirable to be able to adjust the point between the pocket walls at which the jacket is divided for introduction of the inserts while the apparatus is running. To accomplish this, as shown in FIG. 12, each pocket 11 carries side opener 57 which is attached thereto by brackets 59. Rod 58 is slidably mounted therein for movement in either direction as indicated by arrow 60. Divider 61 is adapted for movement in the directions indicated by arrow 62. As the pocket carrying side opener 57 moves past actuating cam 67, actuating cam follower 68 is urged inwardly (toward the upper left), carrying with it divider 61. Rod 58 is spring biased outwardly, so that actuating cam follower 68 will bear against actuating cam 67 as the pocket passes thereby. Thus, the paper is separated thereby into two portions, between which the inserts are to be introduced.

To adjust the dividing point, adjustment cam 66 is provided. Adjustment cam follower 65 is connected to link 64 through pin 63. As adjustment cam follower 65 is urged inward, link 64, and divider 61, are moved toward the lower left. When adjustment cam follower 65 moves outwardly, link 64 and divider 61 move toward the upper right. Since adjustment cam follower 65 is spring biased outwardly, and adjustment cam 66 can be set at various positions in the directions of arrow 69, the precise point at which divider 61 will enter the paper can easily be set. Moreover, since the setting is only of stationary cam 66, this can be accomplished without stopping the operation of the machine.

Although only a limited number of specific embodiments of the present Invention have been expressly disclosed, it is, nonetheless, to be broadly construed and not to be limited except by the character of the claims appended hereto.

What we claim is:

1. An openable pocket, capable of movement in a downstream direction in a closed path, comprising a downstream wall, having an upper edge and a lower edge parallel thereto, and an upstream wall, having a near edge adjacent said lower edge, said upstream wall hinged at said near edge to said downstream wall adjacent said lower edge for movement between an open position, wherein said upstream wall and said downstream wall are spaced apart, and a closed position, wherein said upstream wall and said downstream wall are adjacent each other, an actuator bar, substantially parallel to said near edge, slidably mounted on at least one of said upstream wall and said downstream wall for movement substantially perpendicular to said near edge, whereby pressure on said bar urges at least one said wall toward at least one of said open position and said closed position.

2. The openable pocket of claim 1 wherein said downstream wall is a fixed wall and said upstream wall is a movable wall.

3. The openable pocket of claim 1 wherein at least one said wall has a far edge, remote from said lower edge and parallel thereto, said bar being mounted nearer said far edge than said near edge, when said pocket is in said closed position.

4. The openable pocket of claim 1 wherein said bar has end portions extending beyond said downstream wall and said upstream wall, and actuating rollers are provided on said end portions.

5. The openable pocket of claim 1 wherein said bar and one said wall is biased toward said closed position and said pressure urges one said wall toward said open position.

6. The openable pocket of claim 1 wherein there is a plurality of brackets on at least one said wall, each of which has an opening therethrough parallel to said near edge, said opening being elongated perpendicular to said near edge.

7. The openable pocket of claim 1 wherein said downstream wall has an upper portion adjacent an entire said upper edge and a lower portion adjacent said lower edge, said upper portion being angled in said downstream direction relative to said lower portion, and a vacuum is applied to said upper portion.

8. The openable pocket of claim 7 wherein said bar has end portions which extend beyond said downstream wall and said upstream wall and said pressure is exerted on said end portions.

9. The openable pocket of claim 1 wherein said bar is loosely mounted on said exterior surface and permits said upstream wall to be not parallel to said downstream wall when said pocket is in said closed position.

10. The openable pocket of claim 1 having a near side, perpendicular to said lower edge, and a far side, parallel to said near side and spaced apart therefrom in a transverse direction perpendicular to said downstream direction, a first pair of first bushings, one mounted on said near side of said openable pocket and another mounted on said far side of said openable pocket, said first bushings adapted for connection to an immediately preceding pocket downstream of said openable pocket, a second pair of second bushings, one mounted on said near side of said openable pocket and another mounted on said far side of said openable pocket, said second bushings adapted for connection to an immediately following pocket upstream of said openable pocket, said pockets thereby being adapted to form a linked plurality of successive pockets.

11. A openable pocket, capable of being transported in a closed path in a downstream direction, comprising a downstream wall, having an upper edge and a lower edge parallel thereto, and an upstream wall, said upstream wall and said downstream wall adapted for movement between an open position, wherein said upstream wall and said downstream wall are spaced apart, and a closed position, wherein said upstream wall and said downstream wall are adjacent each other, said openable pocket having a near side perpendicular to said lower edge, and a far side parallel to said near side and spaced apart therefrom in a transverse direction perpendicular to said downstream direction, a first pair of first bushings, one mounted on said near side of said openable pocket and another mounted on said far side of said openable pocket, said first bushings adapted for connection to an immediately preceding pocket downstream of said openable pocket, a second pair of second bushings, one mounted on said near side of said openable pocket and another mounted on said far side of said openable pocket, said second bushings adapted for connection to an immediately following pocket upstream of said openable pocket, thereby to form a linked plurality of successive pockets.

12. The openable pocket of claim 10 wherein said upstream wall is connected by a hinge to said downstream wall adjacent said lower edge.

13. The openable pocket of claim 10 wherein said downstream wall is fixed and said upstream wall is movable.

14. The openable pocket of claim 11 wherein there are a first pair of support rollers, one on each of said first bushings, and a second pair of support rollers, one on each of said second bushings.

15. The openable pocket of claim 11 wherein said downstream wall has an upper portion adjacent an entire said upper edge and a lower portion adjacent said lower edge, said upper portion being bent in said downstream direction relative to said lower portion, and a vacuum is applied to said upper portion.

16. A conveyor for transporting a plurality of flat products in a closed path including a plurality of openable pockets, each of said openable pockets being movable in a closed path in a downstream direction, and comprising a downstream wall, having an upper edge and a lower edge parallel thereto, and a upstream wall, said upstream wall and said downstream wall adapted for movement between an open position, wherein said upstream wall and said downstream wall are spaced apart, and a closed position, wherein said upstream wall and said downstream wall are adjacent, each of said openable pockets having a near side, perpendicular to said lower edge, and a far side, parallel to said near side and spaced apart therefrom in a transverse direction perpendicular to said downstream direction, a first pair of first bushings, one mounted on said near side of each of said openable pockets and another mounted on said far side of each of said openable pockets, an immediately preceding pocket downstream of said openable pocket and engaging said first bushings, a second pair of second bushings, one mounted on said near side of each of said openable pockets and another mounted on said far side of each of said plurality of said openable pockets, an immediately following pocket, upstream of said openable pocket, mounted on said second bushings, thereby forming a linked plurality of adjacent pockets.

17. The conveyor of claim 16 wherein said upstream wall is connected to said downstream wall by a hinge adjacent said lower edge.

18. The conveyor of claim 16 wherein said upstream wall is movable and said downstream wall is fixed.

19. The conveyor of claim 16 wherein said path extends between at least one first rotatable sprocket at one end and an idler end, a middle portion of said path between said one end and said idler end, said ends being higher than said middle portion.

20. The conveyor of claim 19 wherein there is a pair of said sprockets having their planes parallel to each other and spaced apart by a distance substantially equal to a width of said pockets.

21. The conveyor of claim 19 wherein there is at least one idler cam at said idler end around which said pockets pass.

22. The conveyor of claim 21 wherein there is a pair of said idler cams spaced apart from each other by a distance substantially equal to a width of said pockets.

23. The conveyor of claim 19 wherein there is at least one second rotatable sprocket at said idler end.

24. The conveyor of claim 16 wherein said downstream wall has a cut-out portion between said near side and said far side, a distance between said near side and said far side being greater than a width of said cut-out portion.

25. The conveyor of claim 16 wherein one of said upstream wall and said downstream wall has a guiding element which causes said product to assume an arcuate shape concave in said downstream direction or in an upstream direction opposite to said downstream direction as said product is entering said pocket.

26. The conveyor of claim 16 further comprising a feeder adapted to individually insert, from a supply thereof, one of a plurality of flat products into one of said openable pockets.

27. The conveyor of claim 26 wherein said supply comprises a stack of said flat products.

28. The conveyor of claim 26 wherein there are at least two said feeders.

29. The conveyor of claim 16 wherein there are a first pair of support rollers, one on each of said first bushings, and a second pair of support rollers, one on each of said second bushings.

30. The conveyor of claim 16 wherein said downstream wall has an upper portion adjacent an entire said upper edge and a lower portion adjacent said lower edge, said upper portion being angled in said downstream direction relative to said lower portion, and a vacuum is applied to said upper portion.

31. A vacuum system comprising a stationary plenum adjacent a plurality of openable pockets moving in a closed path, said path including a portion in which a vacuum is to be applied to said pockets, said openable pockets having vacuum inlets on sides adjacent said plenum when in said portion of said path;

an endless belt, and rotatable idlers around which said belt passes, thereby forming a near flight and a remote flight of said belt between said rotatable idlers, said near flight being adjacent said pockets and between said plenum and said pockets, a plurality of vacuum holes, complementary to said vacuum inlets, on said belt and adapted to contact or be contacted by said vacuum inlets while in said near flight, whereby vacuum in said plenum is transferred through said vacuum holes to said vacuum inlets, whereby a driving force is transferred from said pockets to said endless belt through temporary coaction of first surfaces, movable with said openable pockets, and second surfaces on said endless belt.

32. The vacuum system of claim 31 wherein said pockets directly drive said endless belt.

33. The vacuum system of claim 32 wherein said vacuum inlets are each provided with at least one protuberance, said belt having at least one notch corresponding to said protuberance, said belt adapted to receive said protuberance in said notch.

34. The vacuum system of claim 33 wherein said protuberance is a pair of teeth.

35. A vacuum system comprising a stationary plenum adjacent a plurality of openable pockets moving in a closed path, said path including a portion in which a vacuum is to be applied to said pockets, said openable pockets having vacuum inlets on sides adjacent said plenum when in said portion of said path;

an endless belt, and rotatable idlers around which said belt passes, thereby forming a near flight and a remote flight of said belt between said rotatable idlers, said near flight being adjacent said pockets and between said plenum and said pockets, a plurality of vacuum holes, complementary to said vacuum inlets, on said belt and adapted to contact or be contacted by said vacuum inlets while in said near flight, whereby vacuum in said plenum is transferred through said vacuum holes to said vacuum inlets, at least one of said openable pockets comprising an upper edge and a lower edge parallel thereto, and an upstream wall, having a near edge adjacent said lower edge, said upstream wall hinged at said near edge to a downstream wall adjacent said lower edge for movement between an open position, wherein said upstream wall and said downstream wall are spaced apart, and a closed position, wherein said upstream wall and said downstream wall are adjacent each other, an actuator bar, substantially parallel to said near edge, slidably mounted on at least one of said upstream wall and said downstream wall for movement substantially perpendicular to said near edge, whereby pressure on said bar urges said upstream wall and/or said downstream wall toward at least one of said open position and said closed position.

36. The vacuum system of claim 35 wherein said upstream wall is movable and said downstream wall is fixed.

37. The vacuum system of claim 31 wherein at least one of said openable pockets comprises a downstream wall, having an upper edge and a lower edge parallel thereto, and an upstream wall, said upstream wall and said downstream wall connected by a hinge adjacent said lower edge for movement between an open position, wherein said upstream wall and said downstream wall are spaced apart, and a closed position, wherein said upstream wall and said downstream wall are adjacent each other, said openable pocket having a near side perpendicular to said hinge, and a far side parallel to said near side and spaced apart therefrom in a transverse direction perpendicular to said downstream direction, a first pair of first bushings, one mounted on said near side of said openable pocket and another mounted on said far side of said openable pocket, said first bushings adapted for connection to an immediately preceding pocket, downstream of said openable pocket, a second pair of second bushings, one mounted on said near side of said openable pocket and another mounted on said far side of said openable pocket, said second bushings adapted for connection to an immediately following pocket, upstream of said openable pocket, said pockets thereby being adapted to form a linked plurality of successive pockets.

38. An openable pocket, capable of transportation in a closed path and adapted to receive and retain a flat, flexible product, said openable pocket comprising a downstream wall, having an upper edge and a lower edge parallel thereto, and an upstream wall, said downstream wall and said upstream wall adjacent said lower edge for movement between an open position, wherein said upstream wall and said downstream wall are spaced apart, and a closed position, wherein said upstream wall and said downstream wall are adjacent each other, a spring having a fixed end mounted on a fixed surface on an outer surface of one of said downstream wall and said upstream wall, said spring extending from said fixed surface parallel to said outer surface toward said lower edge and terminating in a movable end, a lever pivotally mounted on said downstream wall at a pivot point and having an actuated arm extending from said pivot point with a distal end in contact with said movable end of said compression spring, said lever having a receiving arm extending from said pivot point toward said upstream wall or said downstream wall and terminating at a force end, said force end in contact with said upstream wall or said downstream wall, said spring exerting spring force on said actuated arm and said receiving arm so that said force end urges at least one said wall toward said closed position.

39. The openable pocket of claim 38 wherein said upstream wall is movable and said downstream wall is fixed.

40. The openable pocket of claim 38 wherein said force end contacts one of said upstream wall and said downstream wall on an exterior surface thereof re-mote from the other said wall.

41. The openable pocket of claim 38 wherein said spring is a compression spring.

42. The openable pocket of claim 41 wherein one of said upstream wall and said downstream wall has a near edge adjacent and parallel to said lower edge, a bracket on said exterior surface extending parallel to said exterior surface and perpendicular to said near edge, said force end being slidably mounted therein.

43. The openable pocket of claim 38 wherein said pressure end contacts an actuator bar having a diameter, said bar being substantially parallel to said near edge and slidably mounted on said exterior surface for movement substantially perpendicular to said near edge.

44. The openable pocket of claim 43 comprising a bracket on said exterior surface extending parallel to said exterior surface, and perpendicular to said near edge, said bracket being perpendicularly spaced apart from said exterior surface by a distance greater than said diameter, whereby said actuator bar is loosely mounted on said upstream wall which is thereby permitted limited motion with respect thereto.

45. The openable pocket of claim 43 wherein there are two levers, spaced apart parallel to said near edge, each said pressure end engaging said bar.

46. The openable pocket of claim 38 wherein said downstream wall has an upper portion adjacent an entire said upper edge and a lower portion adjacent said lower edge, said upper portion being angled in said downstream direction relative to said lower portion, and a vacuum is applied to said upper portion.

47. The device of claim 45 wherein said upstream wall and said downstream wall are connected by a hinge adjacent said lower edge.

48. A conveyor for transporting a plurality of openable pockets in a downstream direction along a closed path, said conveyor comprising a first rotatable sprocket, an idler end remote from said first sprocket, and a traction device for said plurality of openable pockets, said path extending between said first sprocket and said idler end, each of said operable pockets having at least one support roller, each of said first sprocket and said second sprocket having a periphery, a substantially planar face, and a plurality of notches in said periphery, said notches being spaced apart circumferentially to correspond with spacing of said openable pockets, each of said notches adapted to receive said support roller, a plurality of opening cams on said face of said first sprocket, each of said cams adapted to be contacted by a corresponding opening cam follower on one of said openable pockets as its support roller enters one of said notches, thereby opening each of said pockets and, as each of said openable pockets is carried around said periphery by rotation of said first sprocket, each of said pockets is inverted.

49. The conveyor of claim 48 wherein there is a terminal cam at said idler end around which said pockets pass.

50. The conveyor of claim 48 wherein there is a second rotatable sprocket at said idler end.

51. The conveyor of claim 48 wherein each of said pockets comprises a downstream wall, having an upper edge and a lower edge parallel thereto, and an upstream wall, having a bottom edge adjacent said lower edge, a hinge between said lower edge and said bottom edge, a near side, perpendicular to said hinge and extending from said hinge to said upper edge, a far side, perpendicular to said hinge and extending from said hinge to said upper edge, said near side and said far side being spaced apart by a distance, a first support roller on said near edge and a second support roller on said far edge, said first sprocket comprising a first pair of first wheels spaced apart coaxially from each other by said distance, and said second sprocket comprising a second pair of second wheels spaced apart coaxially from each other by said distance, said first wheels being parallel to each other and said second wheels being parallel to each other.

52. The conveyor of claim 51 wherein said upstream wall is movable and said downstream wall is fixed.

53. The conveyor of claim 51 wherein said opening cams are on said first wheels.

54. The conveyor of claim 48 wherein said plurality of pockets constitutes said traction device.

55. The conveyor of claim 48 wherein said pockets are attached to said traction device.

56. The conveyor of claim 48 wherein a stationary cam is provided at a point at which said pockets exit said first sprocket, said stationary cam contacting a stationary cam follower on each of said pockets to prevent said pockets from closing abruptly.

57. The conveyor of claim 56 wherein said stationary cam follower is said opening cam follower.

58. The conveyor or claim 48 wherein each of said opening cams is movable between a first position, wherein said opening cam can contact with said opening cam follower, and a second position, wherein said opening cam does not contact said opening cam follower, whereby said pockets can be selectively permitted to remain closed.

59. The conveyor of claim 58 wherein said first position is adjacent said face and said second position is remote from said face.

60. The vacuum system of claim 31 wherein said plenum chamber is elongated in a direction of motion of said pockets and extends substantially throughout said portion.

61. The vacuum system of claim 60 wherein said plenum chamber is substantially horizontal.

62. An openable pocket, capable of transportation in a closed path and adapted to receive and retain a flat, flexible product, said openable pocket comprising a downstream wall, having an upper edge and a lower edge parallel thereto, and an upstream wall, adapted for movement between an open position, wherein said upstream wall and said downstream wall are spaced apart, and a closed position, wherein said upstream wall and said downstream wall are adjacent each other, at least one flexible spring on one of said upstream wall and said downstream wall directly contacting and urging said product, when in said openable pocket, toward another of said upstream wall and said downstream wall, said downstream wall having an upper portion adjacent an entire said upper edge and a lower portion adjacent said lower edge, said upper portion being bent in said downstream direction relative to said lower portion, and a vacuum is applied to said upper portion.

* * * * *